US011708233B2

(12) United States Patent
Yoshida et al.

(10) Patent No.: US 11,708,233 B2
(45) Date of Patent: Jul. 25, 2023

(54) SHEET STOP MECHANISM, IMAGE FORMING APPARATUS

(71) Applicant: KYOCERA Document Solutions Inc., Osaka (JP)

(72) Inventors: Takeshi Yoshida, Osaka (JP); Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 120 days.

(21) Appl. No.: 17/037,160

(22) Filed: Sep. 29, 2020

(65) Prior Publication Data

US 2021/0094781 A1 Apr. 1, 2021

(30) Foreign Application Priority Data

Sep. 30, 2019 (JP) ..... 2019-178680

(51) Int. Cl.
*B65H 9/06* (2006.01)

(52) U.S. Cl.
CPC ..... *B65H 9/06* (2013.01); *B65H 2402/31* (2013.01); *B65H 2402/54* (2013.01); *B65H 2801/06* (2013.01)

(58) Field of Classification Search
CPC .. B65H 2405/1111; B65H 2405/11162; B65H 2405/1124; B65H 2405/111646; B65H 2402/31
See application file for complete search history.

(56) References Cited

U.S. PATENT DOCUMENTS

| | | | | |
|---|---|---|---|---|
| 6,428,000 | B1 * | 8/2002 | Hara | B65H 31/20 271/223 |
| 8,424,871 | B2 * | 4/2013 | Ino | B65H 31/20 271/223 |
| 8,857,812 | B2 * | 10/2014 | Yamamoto | B65H 1/04 271/9.09 |
| 8,964,268 | B2 * | 2/2015 | Takahata | B65H 83/02 271/220 |
| 9,513,589 | B2 * | 12/2016 | Arimura | B65H 31/20 |
| 9,630,788 | B2 * | 4/2017 | Horita | B65H 1/00 |
| 11,072,509 | B2 * | 7/2021 | Lo | B65H 31/20 |
| 2021/0373476 | A1 * | 12/2021 | Tobinaga | B65H 9/166 |

FOREIGN PATENT DOCUMENTS

JP 2018109247 A 7/2018

* cited by examiner

*Primary Examiner* — Howard J Sanders
(74) *Attorney, Agent, or Firm* — Alleman Hall Creasman & Tuttle LLP

(57) ABSTRACT

A sheet stop mechanism includes a sheet stopper and a support mechanism. The sheet stopper is formed on a sheet stacking surface. The support mechanism supports the sheet stopper to be rotatable between a stored state and a standing state, wherein in the stored state, the sheet stopper is stored in the sheet stacking surface, and in the standing state, the sheet stopper stands from the sheet stacking surface diagonally upward toward a downstream in the sheet discharge direction. When the sheet stopper is in the standing state, the support mechanism supports the sheet stopper in such a manner that an angle formed between the sheet stopper and the sheet stacking surface becomes small as sheets stacked on the sheet stacking surface increase in number.

6 Claims, 8 Drawing Sheets

SHEET STOP MECHANISM, IMAGE FORMING APPARATUS

INCORPORATION BY REFERENCE

This application is based upon and claims the benefit of priority from the corresponding Japanese Patent Application No. 2019-178680 filed on Sep. 30, 2019, the entire contents of which are incorporated herein by reference.

BACKGROUND

The present disclosure relates to: a sheet stop mechanism provided on a discharge tray; and an image forming apparatus including the sheet stop mechanism.

An image forming apparatus may include a sheet stopper provided on a discharge tray that receives sheets discharged from a sheet discharge port. The sheet stopper prevents the sheets from slipping down from the discharge tray.

For example, there is known a technique where the sheet stopper is supported to be rotatable between a stored state and a standing state, wherein in the stored state, the sheet stopper is stored in a tray recess formed in the discharge tray, and in the standing state, the sheet stopper stands from the tray recess diagonally upward toward the downstream in a sheet discharge direction at a predetermined angle.

According to the above-mentioned technique, the sheet stopper is changed from the stored state to the standing state when a large-size sheet that is larger than a predetermined standard size is used. A tip end part of the large-size sheet rides over the sheet stopper in the standing state. With this configuration, the sheet stopper prevents the large-size sheet from slipping down from the discharge tray.

In addition, there may be a case where the image forming apparatus includes a lower unit and an upper unit, wherein the lower unit includes a print device that forms an image on a sheet, and the upper unit includes an image reading device and an operation device. The upper unit is located above the lower unit and connected with the lower unit. In this case, the image forming apparatus has what is called an in-body discharge structure in which the discharge tray is formed on the upper surface of the lower unit.

SUMMARY

A sheet stop mechanism according to an aspect of the present disclosure includes a sheet stopper and a support mechanism. The sheet stopper is formed on a sheet stacking surface that receives a sheet discharged from a sheet discharge port, wherein the sheet stacking surface extends from a wall in a sheet discharge direction and gradually ascends toward its tip, and the wall extends downward from the sheet discharge port. The support mechanism supports the sheet stopper to be rotatable between a stored state and a standing state, wherein in the stored state, the sheet stopper is stored in the sheet stacking surface, and in the standing state, the sheet stopper stands from the sheet stacking surface diagonally upward toward a downstream in the sheet discharge direction at a predetermined angle. When the sheet stopper is in the standing state, the support mechanism supports the sheet stopper in such a manner that an angle formed between the sheet stopper and the sheet stacking surface becomes small as sheets stacked on the sheet stacking surface increase in number.

An image forming apparatus according to another aspect of the present disclosure includes a sheet conveyance device, a print device, a discharge tray, and the sheet stop mechanism according provided in the discharge tray. The sheet conveyance device conveys a sheet along a sheet conveyance path and discharges the sheet from a sheet discharge port of the sheet conveyance path. The print device forms an image on the sheet conveyed along the sheet conveyance path. The discharge tray receives the sheet discharged from the sheet discharge port.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

A sheet stop mechanism 5 according to a first embodiment constitutes a part of an image forming apparatus 10.

[Configuration of Image Forming Apparatus 10]

Figure 1:
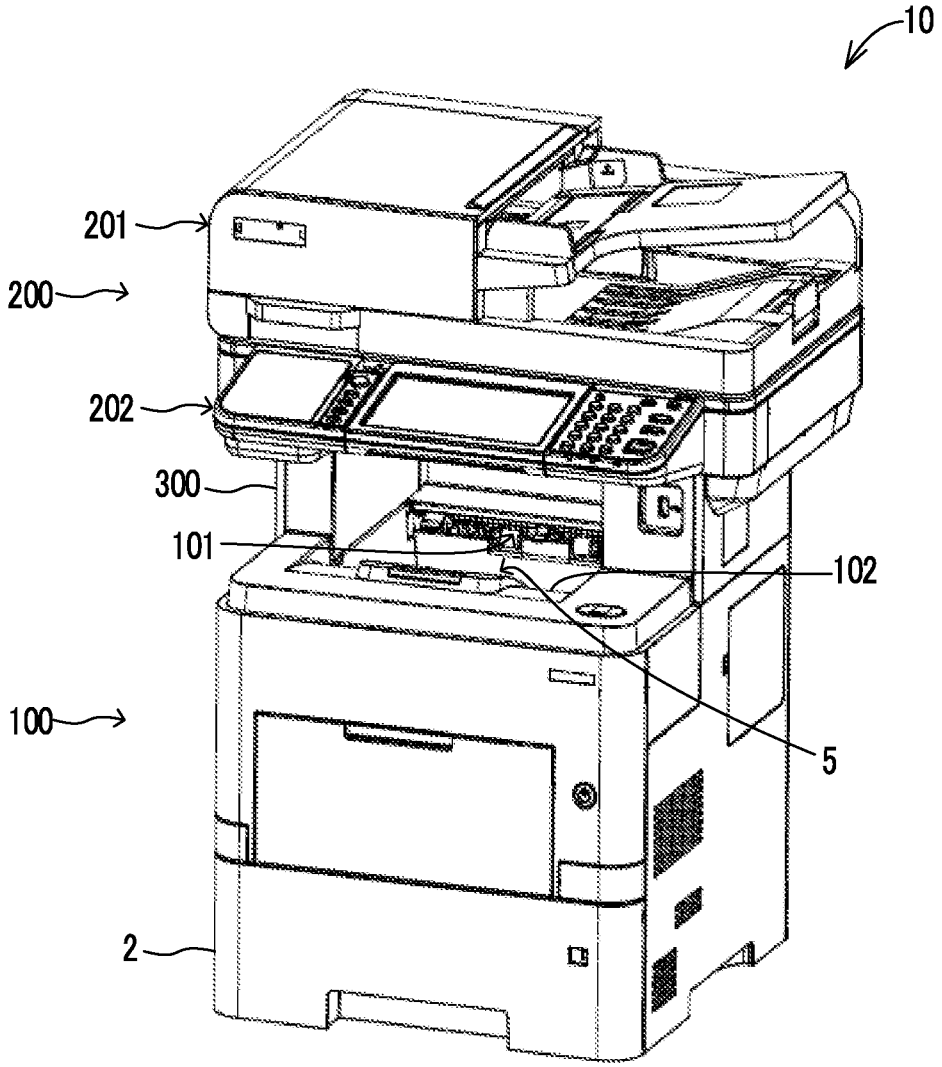
FIG. 1 is a perspective diagram of an image forming apparatus including a sheet stop mechanism according to a first embodiment.

As shown in FIG. 1, the image forming apparatus 10 includes a lower unit 100, an upper unit 200, and a connection portion 300.

The upper unit 200 is located above the lower unit 100 and connected with the lower unit 100 by the connection portion 300. The upper unit 200 includes an image reading device 201 and an operation portion 202.

The image reading device 201 is what is called a scanner that reads an image from a document sheet. The operation portion 202 is a device that receives a human operation. The operation portion 202 is equipped with, for example, a touch panel and operation buttons.

Figure 2:
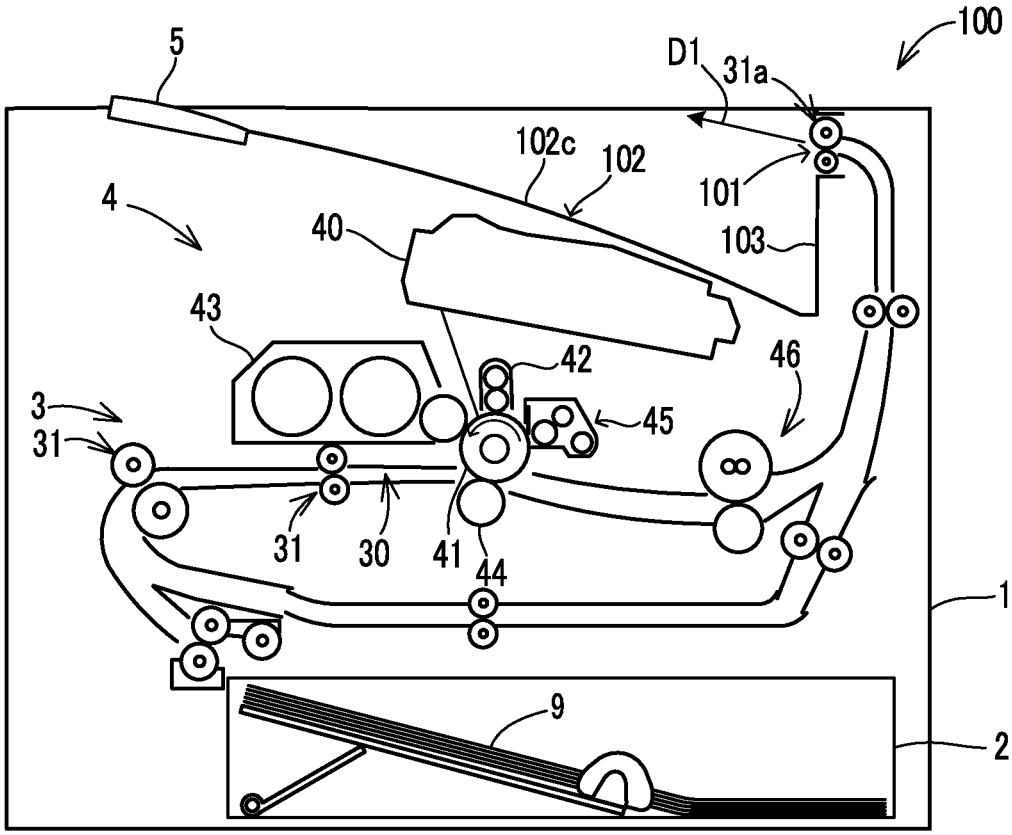
FIG. 2 is a configuration diagram of a lower unit of the image forming apparatus including the sheet stop mechanism according to the first embodiment.

As shown in FIG. 2, the lower unit 100 includes a sheet conveyance device 3, a print device 4, and a main housing 1 that stores the sheet conveyance device 3 and the print device 4. That is, the lower unit 100 includes the print device 4 and the sheet conveyance device 3.

The sheet conveyance device 3 feeds a sheet 9 stored in a sheet storage portion 2 to a sheet conveyance path 30 provided in the main housing 1. Furthermore, the sheet conveyance device 3 conveys the sheet 9 along the sheet conveyance path 30, and discharges the sheet 9 from a sheet discharge port 101 of the sheet conveyance path 30.

The sheet conveyance device 3 includes a plurality of pairs of conveyance rollers 31 which each convey the sheet 9 by rotating while holding the sheet 9 therebetween. The plurality of pairs of conveyance rollers 31 include a pair of discharge rollers 31*a* that are arranged at the sheet discharge port 101, and discharge the sheet 9 with an image formed thereon from the sheet discharge port 101 onto a discharge tray 102.

Figure 3:
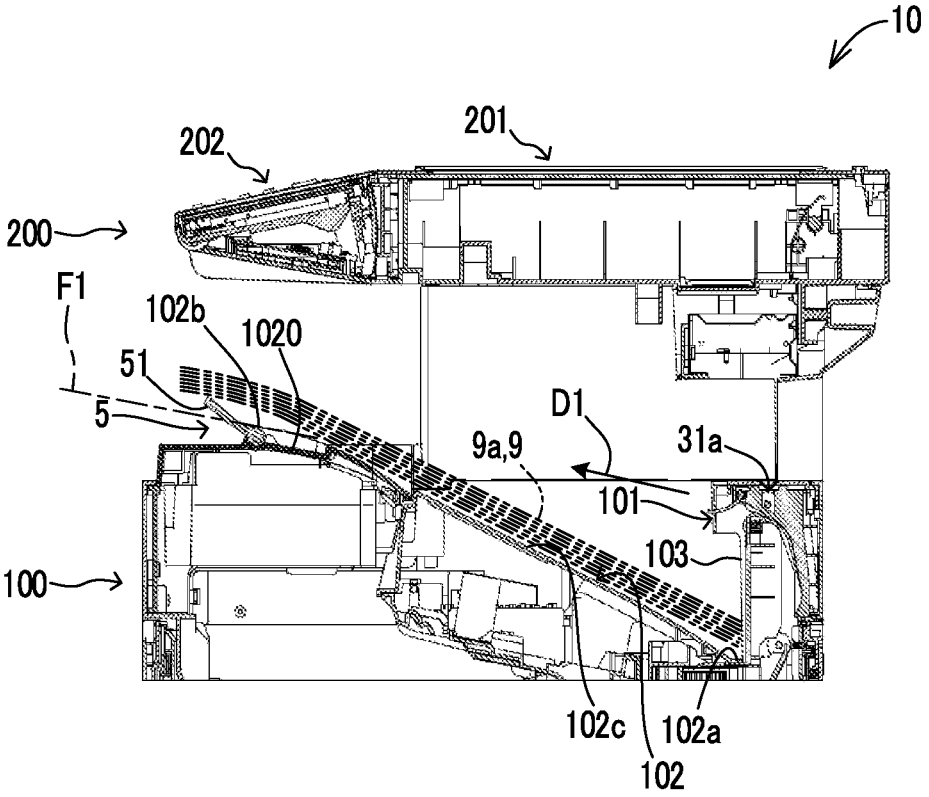
FIG. 3 is a cross-section diagram of a discharge tray and its peripheral in the image forming apparatus including the sheet stop mechanism according to the first embodiment.

The lower unit 100 further includes the discharge tray 102 that receives the sheets 9 discharged from the sheet discharge port 101. As shown in FIG. 3, the upper surface of the discharge tray 102 forms a sheet stacking surface 102*c* that receives the sheet 9 discharged from the sheet discharge port 101. The discharge tray 102 is formed on the upper surface of the lower unit 100 and faces the lower surface of the upper unit 200 (see FIG. 1). In general, the structure of the discharge tray 102 is called an in-body discharge structure.

The print device 4 executes a print process to form an image on the sheet 9 conveyed along the sheet conveyance path 30. In the example shown in FIG. 2, the print device 4 executes the print process by an electrophotographic method. In this case, the print device 4 includes a photoconductor 41, a charging device 42, a laser scanning unit 40, a developing device 43, a transfer device 44, a cleaning device 45, and a fixing device 46.

The charging device 42 electrically charges a surface of the photoconductor 41 while the photoconductor 41 is rotating. The laser scanning unit 40 writes an electrostatic latent image on the charged surface of the photoconductor 41 by scanning a laser light on the surface.

The developing device 43 develops the electrostatic latent image into a toner image by supplying toner to the surface of the photoconductor 41. It is noted that the photoconductor 41 is an example of an image carrier that rotates while carrying the toner image.

The transfer device 44 transfers the toner image on the photoconductor 41 to the sheet 9. The cleaning device 45 removes residual toner from the surface of the photoconductor 41. The fixing device 46 fixes the toner image to the sheet 9 by heating and applying pressure to the toner image on the sheet 9.

The image forming apparatus 10 further includes the sheet stop mechanism 5 provided on the sheet stacking surface 102*c*. The sheet stop mechanism 5 includes a sheet stopper 51 that prevents the sheet 9 from slipping down from the sheet stacking surface 102*c* (see FIG. 3). The sheet stopper 51 is provided in a tray recessed portion 1020 formed in the sheet stacking surface 102*c*.

The tray recessed portion 1020 is provided at a downstream end of the sheet stacking surface 102*c* in a sheet discharge direction D1, and the sheet stopper 51 is attached to the tray recessed portion 1020. The tray recessed portion 1020 is an example of an attachment recess.

In the following description, a direction in which the sheet 9 is discharged from the sheet discharge port 101 is referred to as the sheet discharge direction D1.

The sheet stacking surface 102*c* is formed to extend from a lower end of a wall 103 in the sheet discharge direction D1 and gradually ascend toward its tip, wherein the wall 103 extends downward from the sheet discharge port 101. In other words, the sheet stacking surface 102*c* is formed to be inclined diagonally upward from a first end 102*a* to a second end 102*b*, wherein the first end 102*a* is an upstream end in the sheet discharge direction D1, and the second end 102*b* is a downstream end in the sheet discharge direction D1. The first end 102*a* is located below the sheet discharge port 101.

In the sheet stop mechanism 5, the sheet stopper 51 is supported to be rotatable between a stored state and a standing state. In the stored state, the sheet stopper 51 is stored in the tray recessed portion 1020 of the sheet stacking surface 102*c*. In the standing state, the sheet stopper 51 stands from the tray recessed portion 1020 diagonally upward toward the downstream in the sheet discharge direction D1. FIG. 3 shows the sheet stopper 51 in the standing state.

The sheet stopper 51 is changed from the stored state to the standing state when a large-size sheet 9*a* that is larger than a predetermined standard size is used (see FIG. 3). As shown in FIG. 3, a tip end part of the large-size sheet 9*a* rides over the sheet stopper 51 in the standing state. With this configuration, the sheet stopper 51 prevents the large-size sheet 9*a* from slipping down from the sheet stacking surface 102*c* toward the downstream in the sheet discharge direction D1.

Figure 4:
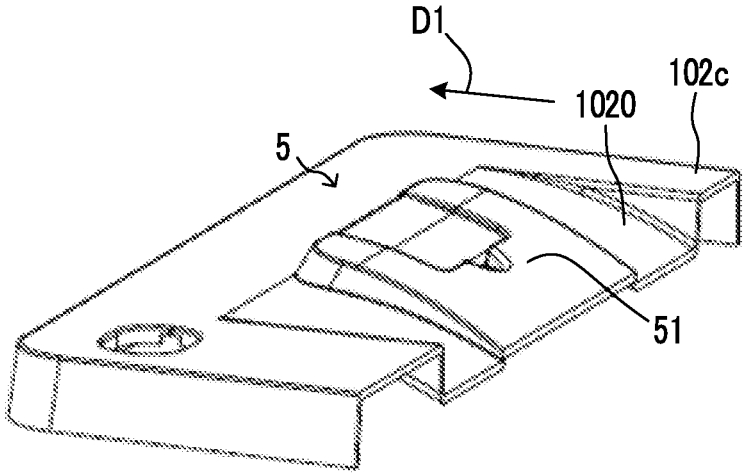
FIG. 4 is a perspective diagram of the sheet stop mechanism in a stored state according to the first embodiment.
Figure 6:
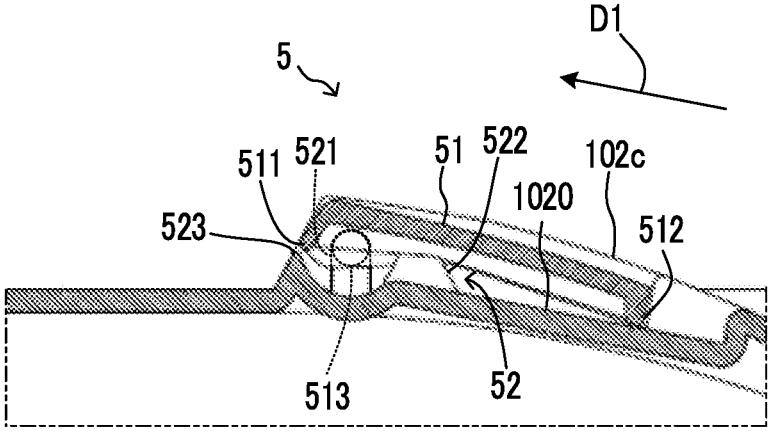
FIG. 6 is a cross-section diagram of the sheet stop mechanism in the stored state according to the first embodiment.

It is noted that when the sheet 9 of a standard size is used, the sheet stopper 51 is in the stored state (see FIG. 4, FIG. 6). With this configuration, the sheet stopper 51 does not become a hindrance to taking out the sheet 9 from the discharge tray 102.

In the following description, a plane along a peripheral portion of the tray recessed portion 1020 of the sheet stacking surface 102*c* is referred to as a reference plane F1 (see FIG. 3).

Meanwhile, when the image forming apparatus 10 has the in-body discharge structure, the sheet stacking surface 102*c* faces the lower surface of the upper unit 200. As a result, the larger the inclination angle of the sheet stopper 51 to the reference plane F1, the narrower the space between the sheet stacking surface 102*c* and the upper unit 200 in which sheets 9 are stacked.

On the other hand, when the inclination angle of the sheet stopper 51 to the reference plane F1 is too small, the large-size sheets 9*a* may slip down from the sheet stacking surface 102*c*.

The sheet stop mechanism 5 has a structure to prevent the space in the discharge tray 102 of the in-body discharge type in which large-size sheets 9*a* are stacked, from becoming narrow, while preventing the large-size sheets 9*a* from slipping down from the sheet stacking surface 102*c*. The following describes the structure of the sheet stop mechanism 5.

[Structure of Sheet Stop Mechanism 5]

As shown in FIG. 5 to FIG. 8, the sheet stop mechanism 5 includes the sheet stopper 51 and a support mechanism 52. The support mechanism 52 supports the sheet stopper 51 to be rotatable between the stored state and the standing state.

Figure 5:
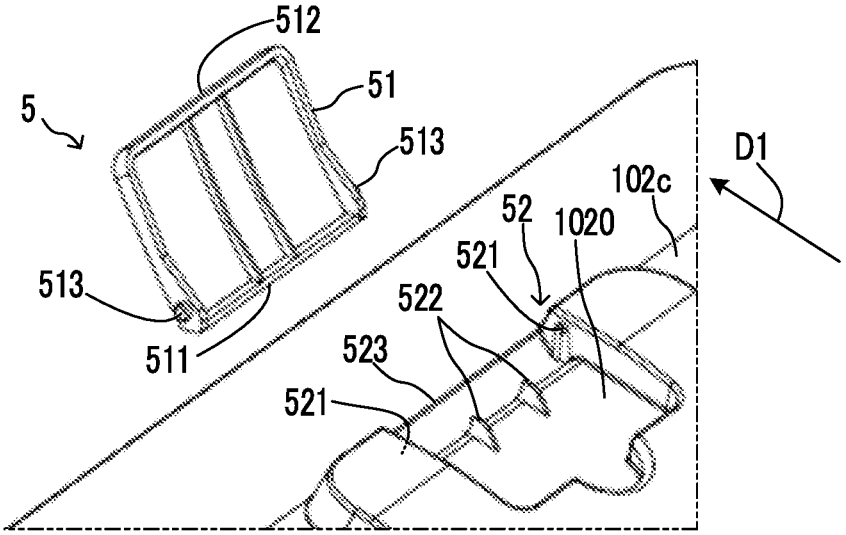
FIG. 5 is a broken perspective diagram of the sheet stop mechanism according to the first embodiment.

As shown in at least FIG. 5, the support mechanism 52 includes a rotation support portion 521, two ribs 522, and a restriction portion 523. The sheet stopper 51 includes a pair of supported portions 513 that are formed at opposite ends in the width direction perpendicular to the sheet discharge direction D1. In the present embodiment, the pair of supported portions 513 are projection portions.

The pair of supported portions 513 are formed at a position closer to a base end portion 511 of the sheet stopper 51, between the base end portion 511 and a tip end portion 512 of the sheet stopper 51 that is located opposite to the base end portion 511.

The rotation support portion 521 is provided on the downstream side in the tray recessed portion 1020 in the sheet discharge direction D1. The rotation support portion 521 supports the pair of supported portions 513 of the sheet stopper 51 rotatably. That is, the rotation support portion 521 supports the sheet stopper 51 rotatably, using, as the base end portion 511, an end portion of the sheet stopper 51 in the stored state on the downstream side in the sheet discharge direction D1. In the present embodiment, the rotation support portion 521 is composed of a pair of recessed portions in which the pair of supported portions 513 are respectively fitted rotatably.

The sheet stopper 51 is operated by the user to rotate from one of the stored state and the standing state to the other. It is noted that the supported portions 513 may be recessed portions and the rotation support portion 521 may be composed of projection portions.

The two ribs 522 are formed to stand in the tray recessed portion 1020. The two ribs 522 are covered with the sheet stopper 51 when the sheet stopper 51 is in the stored state (see FIG. 6).

Figure 7:
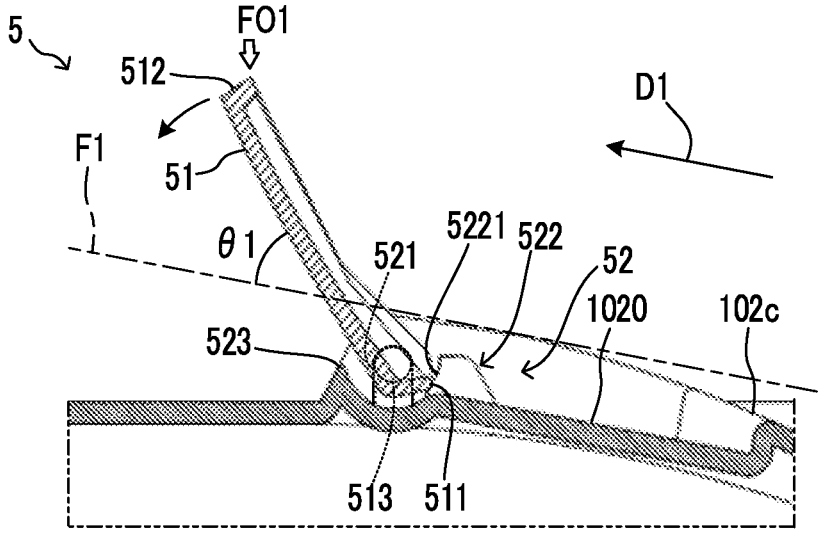
FIG. 7 is a cross-section diagram of the sheet stop mechanism in a first standing state according to the first embodiment.
Figure 8:
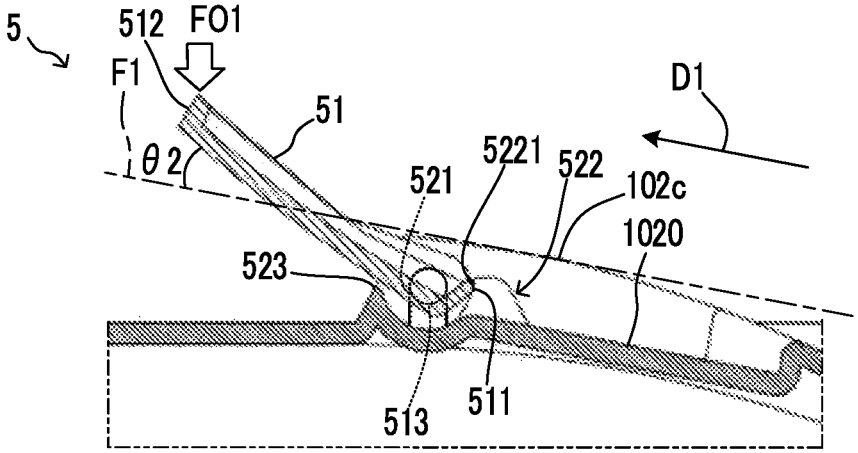
FIG. 8 is a cross-section diagram of the sheet stop mechanism in a second standing state according to the first embodiment.

As shown in FIG. 7 and FIG. 8, each of the two ribs 522 includes a friction portion 5221 that comes in contact with the base end portion 511 of the sheet stopper 51 when the sheet stopper 51 is in the standing state.

As shown in FIG. 7, the friction portions 5221 hold the sheet stopper 51 at a first acute angle θ1 with respect to the reference plane F1, by a friction force generated by contact with the base end portion 511.

When a load FO1 of a plurality of large-size sheets 9*a* is applied to the tip end portion 512 of the sheet stopper 51, a force along an arc around the supported portions 513 acts on the base end portion 511 of the sheet stopper 51 by the principle of leverage.

The friction portions 5221 hold the sheet stopper 51 at the first acute angle θ1 with respect to the reference plane F1 until the load FO1 of the plurality of large-size sheets 9*a* is applied to the tip end portion 512 of the sheet stopper 51 and a force exceeding the friction force acts on the base end portion 511.

When the load FO1 of the plurality of large-size sheets 9*a* is applied to the tip end portion 512 of the sheet stopper 51 and a force exceeding the friction force acts on the base end portion 511, the base end portion 511 slides on the friction portions 5221 and the sheet stopper 51 rotates in a direction where the acute angle formed between the sheet stopper 51 and the reference plane F1 becomes small.

The restriction portion 523 is provided downstream of the rotation support portion 521 in the sheet discharge direction D1 in the tray recessed portion 1020.

When the sheet stopper 51 rotates in the direction where the acute angle formed between the sheet stopper 51 and the reference plane F1 becomes small, the restriction portion 523 restricts the rotation of the sheet stopper 51 by abutting on a part of the sheet stopper 51. This allows the restriction portion 523 to hold the sheet stopper 51 at a second acute angle θ2 with respect to the reference plane F1 (see FIG. 8). The second acute angle θ2 is smaller than the first acute angle θ1.

With the configuration described above, when the support mechanism 52 supports the sheet stopper 51 in the standing state, the support mechanism 52 supports the sheet stopper 51 in such a manner that the sheet stopper 51 is displaced in a direction where the acute angle formed between the sheet stopper 51 and the reference plane F1 becomes small as the large-size sheets 9*a* stacked on the sheet stacking surface 102*c* increase in number.

With the adoption of the sheet stop mechanism 5, when the large-size sheets 9*a* stacked on the sheet stacking surface 102*c* increase in amount, the sheet stopper 51 is displaced in a direction where the acute angle formed between the sheet stopper 51 and the reference plane F1 becomes small, thereby securing the space between the sheet stacking surface 102*c* and the upper unit 200 in which the large-size sheets 9*a* are stacked.

In addition, in a state where a large amount of large-size sheets 9*a* is stacked on the sheet stacking surface 102*c*, there is a small difference in height between the sheet discharge port 101 and the upper surface of the large-size sheets 9*a* stacked on the sheet stacking surface 102*c*. In this case, the large-size sheet 9*a* discharged from the sheet discharge port 101 reduces its speed quickly by coming in contact with the large-size sheets 9*a* on the sheet stacking surface 102*c* relatively in a short time.

As a result, in this case, even when the sheet stopper 51 becomes the state of forming the second acute angle θ2 with respect to the reference plane F1, the large-size sheets 9*a* do not slip down from the sheet stacking surface 102*c*.

In addition, in a case where the inclination angle of the sheet stopper 51 is large, when the large-size sheets 9*a* stacked on the sheet stacking surface 102*c* increase in weight, the large-size sheets 9*a* may be damaged by partially receiving a strong force from the sheet stopper 51.

However, with the adoption of the sheet stop mechanism 5, when the stacked large-size sheets 9*a* increase in amount, the damage given from the sheet stopper 51 to the large-size sheets 9*a* is reduced.

It is noted that when the large-size sheets 9*a* are removed from the sheet stacking surface 102*c* of the support mechanism 52, the user needs to return the sheet stopper 51 to the state of forming the first acute angle θ1 with respect to the reference plane F1.

Second Embodiment

Figure 9:
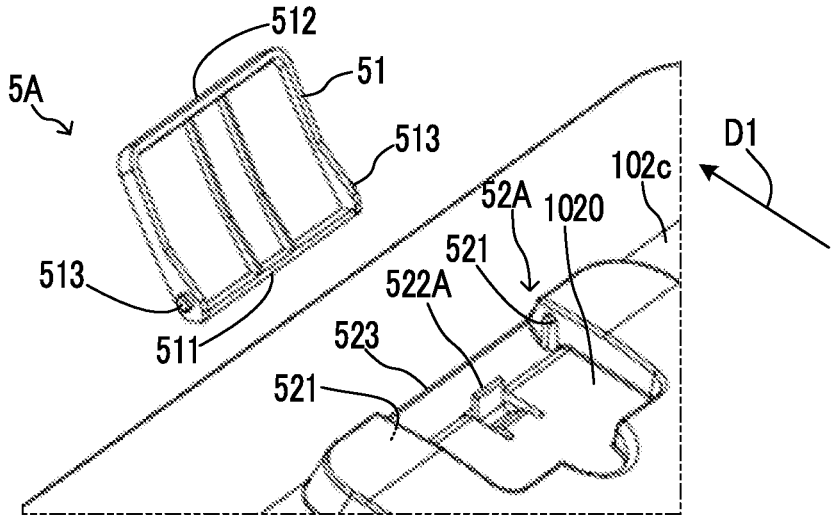
FIG. 9 is a broken perspective diagram of the sheet stop mechanism according to a second embodiment.
Figure 10:
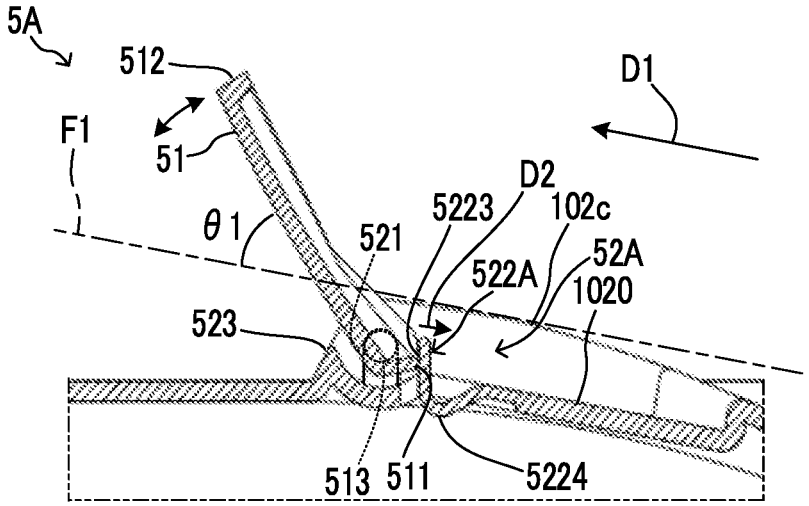
FIG. 10 is a cross-section diagram of the sheet stop mechanism in the first standing state according to the second embodiment.
Figure 11:
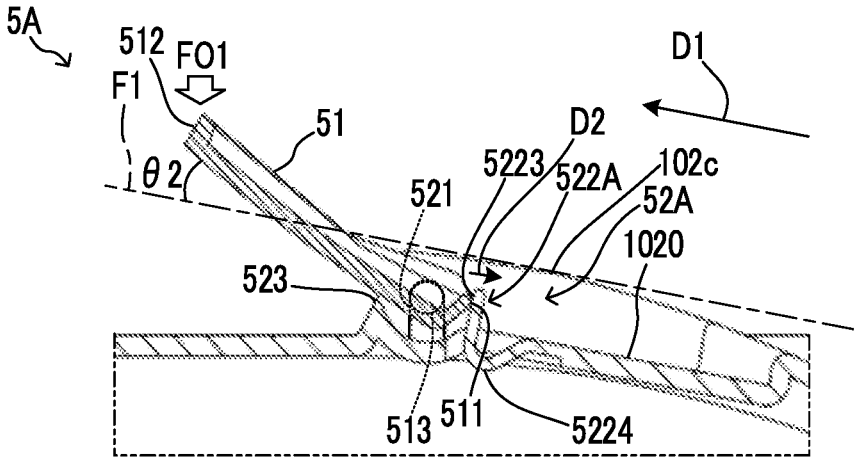
FIG. 11 is a cross-section diagram of the sheet stop mechanism in the second standing state according to the second embodiment.

Next, a description is given of a sheet stop mechanism 5A according to a second embodiment with reference to FIG. 9 to FIG. 11. The sheet stop mechanism 5A is adopted in place of the sheet stop mechanism 5 in the image forming apparatus 10.

In FIG. 9 to FIG. 11, the same components as those shown in FIG. 1 to FIG. 8 are assigned the same reference signs.

The following describes differences of the sheet stop mechanism 5A from the sheet stop mechanism 5. In the sheet stop mechanism 5A, the support mechanism 52 of the sheet stop mechanism 5 has been replaced with a support mechanism 52A.

The support mechanism 52A includes the rotation support portion 521, an elastic support piece 522A, and the restriction portion 523. The rotation support portion 521 and the restriction portion 523 of the support mechanism 52A are the same as the rotation support portion 521 and the restriction portion 523 of the support mechanism 52.

The elastic support piece 522A is provided upstream of the rotation support portion 521 in the sheet discharge direction D1 in the tray recessed portion 1020 of the sheet stacking surface 102*c*. The elastic support piece 522A is covered with the sheet stopper 51 when the sheet stopper 51 is in the stored state (not shown).

The elastic support piece 522A is a part of a synthetic resin member and is integrally formed with the tray recessed portion 1020. The elastic support piece 522A is formed in the shape of a curved plate that extends from the tray recessed portion 1020.

The elastic support piece 522A includes a contact displacement portion 5223 and an elastically biasing portion 5224. The contact displacement portion 5223 is a portion of the elastic support piece 522A close to a tip of the elastic support piece 522A. The elastically biasing portion 5224 is a curved portion of the elastic support piece 522A.

When a force is applied to the contact displacement portion 5223, the elastically biasing portion 5224 is elastically deformed, and the contact displacement portion 5223 is displaced in a predetermined retracting direction D2 (see FIG. 10, FIG. 11). The retracting direction D2 is a direction of moving away from the supported portions 513 of the sheet stopper 51.

When the sheet stopper 51 is in the standing state, the contact displacement portion 5223 comes in contact with the base end portion 511 of the sheet stopper 51. This allows the contact displacement portion 5223 to hold the sheet stopper 51 at the first acute angle θ1 with respect to the reference plane F1.

In the following description, the position of the contact displacement portion 5223, when it holds the sheet stopper 51 at the first acute angle θ1 with respect to the reference plane F1, is referred to as a reference position. FIG. 10 shows a state where the contact displacement portion 5223 is located at the reference position.

The elastically biasing portion 5224 applies an elastic force to the contact displacement portion 5223 that comes in contact with the base end portion 511 of the sheet stopper 51.

That is, the elastic support piece 522A comes in contact with the base end portion 511 of the sheet stopper 51 when the sheet stopper 51 is in the standing state, and is elastically deformed in the retracting direction D2 from the reference position at which the sheet stopper 51 is held at the first acute angle θ1 with respect to the sheet stacking surface 102*c*. It is noted that the elastic support piece 522A is an example of an elastic support portion.

The elastically biasing portion 5224 holds the contact displacement portion 5223 at the reference position by applying the elastic force to the contact displacement portion 5223 until the contact displacement portion 5223 receives a pressing force exceeding a predetermined upper-limit pressure from the base end portion 511 in the retracting direction D2.

However, when the load FO1 of a plurality of large-size sheets 9*a* is applied to the tip end portion 512 of the sheet stopper 51 and a force exceeding the upper-limit pressure is applied from the base end portion 511 to the contact displacement portion 5223, the elastically biasing portion 5224 is elastically deformed. This allows the contact displacement portion 5223 to be displaced from the reference position in the retracting direction D2, and the sheet stopper 51 rotates in a direction where the acute angle formed by the sheet stopper 51 with respect to the reference plane F1 becomes small.

When the sheet stopper 51 rotates in the direction where the acute angle formed by the sheet stopper 51 with respect to the reference plane F1 becomes small, the restriction portion 523 abuts on a part of the sheet stopper 51 and thereby holds the sheet stopper 51 at the second acute angle θ2 with respect to the reference plane F1 (see FIG. 11). The second acute angle θ2 is smaller than the first acute angle θ1.

With the configuration described above, when the support mechanism 52A supports the sheet stopper 51 in the standing state, the support mechanism 52A supports the sheet stopper 51 in such a manner that the sheet stopper 51 is displaced in a direction where the acute angle formed between the sheet stopper 51 and the reference plane F1 becomes small as the large-size sheets 9*a* stacked on the sheet stacking surface 102*c* increase in number.

That is, the support mechanism 52A realizes the same function as that of the support mechanism 52 by a different configuration. With the adoption of the sheet stop mechanism 5A, the same effect as that of the sheet stop mechanism 5 is produced.

In addition, the contact displacement portion 5223 and the elastically biasing portion 5224 are integrally formed from an elastically deformable material. As a result, the support mechanism 52A has a simple configuration as is the case with the support mechanism 52.

In the support mechanism 52A, when the large-size sheets 9*a* are removed from the sheet stacking surface 102*c*, the elastically biasing portion 5224 automatically returns to its original shape. This allows the contact displacement portion 5223 to automatically return the sheet stopper 51 to the state of forming the first acute angle θ1 with respect to the reference plane F1.

Third Embodiment

Figure 12:
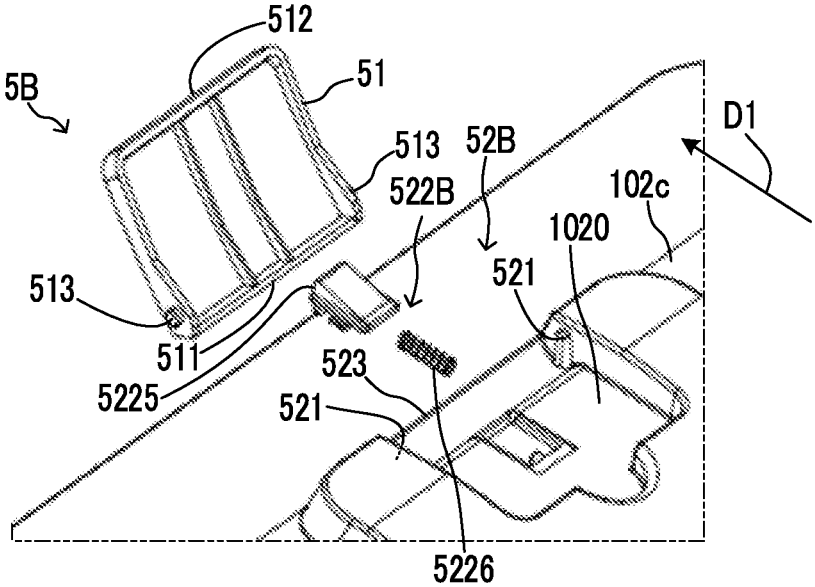
FIG. 12 is a broken perspective diagram of the sheet stop mechanism according to a third embodiment.
Figure 13:
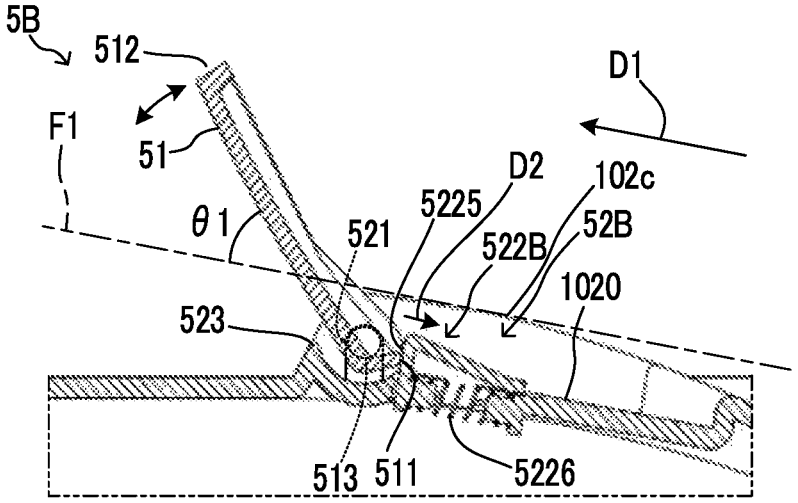
FIG. 13 is a cross-section diagram of the sheet stop mechanism in the first standing state according to the third embodiment.
Figure 14:
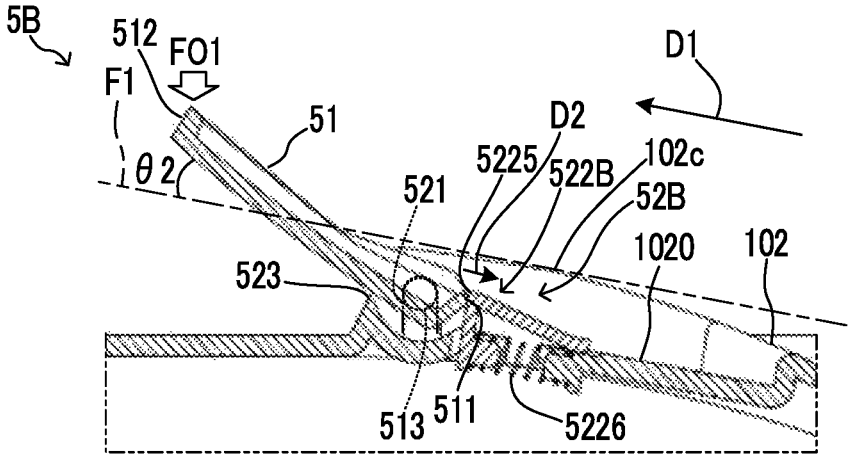
FIG. 14 is a cross-section diagram of the sheet stop mechanism in the second standing state according to the third embodiment.

Next, a description is given of a sheet stop mechanism 5B according to a third embodiment with reference to FIG. 12 to FIG. 14. The sheet stop mechanism 5B is adopted in place of the sheet stop mechanism 5 in the image forming apparatus 10.

In FIG. 12 to FIG. 14, the same components as those shown in FIG. 1 to FIG. 8 are assigned the same reference signs.

The following describes differences of the sheet stop mechanism 5B from the sheet stop mechanism 5. In the sheet stop mechanism 5B, the support mechanism 52 of the sheet stop mechanism 5 has been replaced with a support mechanism 52B.

The support mechanism 52B includes the rotation support portion 521, an elastic movable mechanism 522B, and the restriction portion 523. The rotation support portion 521 and the restriction portion 523 of the support mechanism 52B are the same as the rotation support portion 521 and the restriction portion 523 of the support mechanism 52.

The elastic movable mechanism 522B is provided in the tray recessed portion 1020 of the sheet stacking surface 102*c*. The elastic movable mechanism 522B is covered with the sheet stopper 51 when the sheet stopper 51 is in the stored state (not shown). The elastic movable mechanism 522B includes a movable member 5225 and a spring 5226.

The movable member 5225 is supported by the tray recessed portion 1020 in such a way as to be slidable in a direction toward the base end portion 511 of the sheet stopper 51 and in the opposite direction. The spring 5226 elastically biases the movable member 5225 toward the base end portion 511 of the sheet stopper 51.

When a force is applied to the movable member 5225, the spring 5226 is elastically deformed, and the movable member 5225 is displaced in the retracting direction D2 (see FIG. 13, FIG. 14). The retracting direction D2 is a direction of moving away from the supported portions 513 of the sheet stopper 51.

When the sheet stopper 51 is in the standing state, the movable member 5225 comes in contact with the base end portion 511 of the sheet stopper 51. This allows the movable member 5225 to hold the sheet stopper 51 at the first acute angle θ1 with respect to the reference plane F1.

In the following description, the position of the movable member 5225, when it holds the sheet stopper 51 at the first acute angle θ1 with respect to the reference plane F1, is referred to as a reference position. FIG. 13 shows a state where the movable member 5225 is located at the reference position.

The spring 5226 applies an elastic force to the movable member 5225 that comes in contact with the base end portion 511 of the sheet stopper 51.

The spring 5226 holds the movable member 5225 at the reference position by applying the elastic force to the movable member 5225 until the movable member 5225 receives a pressing force exceeding a predetermined upper-limit pressure from the base end portion 511 in the retracting direction D2.

When the load FO1 of a plurality of large-size sheets 9*a* is applied to the tip end portion 512 of the sheet stopper 51 and a force exceeding the upper-limit pressure is applied from the base end portion 511 to the movable member 5225, the spring 5226 is elastically deformed. This allows the movable member 5225 to be displaced from the reference position in the retracting direction D2, and the sheet stopper 51 rotates in a direction where the acute angle formed by the sheet stopper 51 with respect to the reference plane F1 becomes small.

When the sheet stopper 51 rotates in the direction where the acute angle formed by the sheet stopper 51 with respect to the reference plane F1 becomes small, the restriction portion 523 abuts on a part of the sheet stopper 51 and thereby holds the sheet stopper 51 at the second acute angle θ2 with respect to the reference plane F1 (see FIG. 14). The second acute angle θ2 is smaller than the first acute angle θ1.

It is noted that the movable member 5225 is an example of a contact displacement portion that comes in contact with the base end portion 511 of the sheet stopper 51. In addition, the spring 5226 is an example of an elastically biasing portion that holds the movable member 5225 at the reference position by the elastic force.

With the configuration described above, when the support mechanism 52B supports the sheet stopper 51 in the standing state, the support mechanism 52B supports the sheet stopper 51 in such a manner that the sheet stopper 51 is displaced in a direction where the acute angle formed between the sheet stopper 51 and the reference plane F1 becomes small as the large-size sheets 9*a* stacked on the sheet stacking surface 102*c* increase in number.

In the support mechanism 52B, when the large-size sheets 9*a* are removed from the sheet stacking surface 102*c*, the spring 5226 automatically returns to its original shape. This allows the movable member 5225 to return the sheet stopper 51 automatically to the state of forming the first acute angle θ1 with respect to the reference plane F1.

That is, the support mechanism 52B realizes the same function as that of the support mechanism 52A by a different configuration. With the adoption of the sheet stop mechanism 5B, the same effect as that of the sheet stop mechanism 5A is produced.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet stop mechanism comprising:

a sheet stopper formed on a sheet stacking surface that receives a sheet discharged from a sheet discharge port, the sheet stacking surface extending from a wall in a sheet discharge direction and gradually ascending toward its tip, the wall extending downward from the sheet discharge port; and a support mechanism configured to support the sheet stopper to be rotatable between a stored state and a standing state, wherein in the stored state, the sheet stopper is stored in the sheet stacking surface, and in the standing state, the sheet stopper stands from the sheet stacking surface diagonally upward toward a downstream in the sheet discharge direction at a predetermined angle, wherein the support mechanism includes:

an attachment recess provided at a downstream end of the sheet stacking surface in the sheet discharge direction, the sheet stopper being attached to the attachment recess;

a rotation support portion provided in the attachment recess and configured to support the sheet stopper in such a manner that the sheet stopper is configured to rotate around a pair of supported portions formed close to a base end portion of the sheet stopper the base end portion being an end portion of the sheet stopper in the stored state on a downstream side in the sheet discharge direction;

a friction portion provided upstream of the rotation support portion in the sheet discharge direction in the attachment recess; and a restriction portion provided on an upper edge portion downstream of the friction portion in the sheet discharge direction in the attachment recess, when the sheet stopper is in the standing state, the support mechanism allows a leading tip end part of the sheet on the sheet stacking surface to ride over the sheet stopper, the sheet stopper is pivotably supported by the support mechanism in such a manner that the angle formed between the sheet stopper and the sheet stacking surface changes between a first acute angle and a second acute angle as a load of sheets stacked on the sheet stacking surface changes, the second acute angle being smaller than the first acute angle, the friction portion holds the sheet stopper at the first acute angle with respect to the sheet stacking surface by a friction force generated by contact with the base end portion of the sheet stopper in the standing state, when the load of the sheets exceeding the friction force is applied to the sheet stopper held at the first acute angle, the sheet stopper rotates in a direction where an acute angle formed between the sheet stopper and the sheet stacking surface becomes smaller than the first acute angle, and when the sheet stopper rotates in the direction where the acute angle formed between the sheet stopper and the sheet stacking surface becomes smaller than the first acute angle, the restriction portion restricts a rotation of the sheet stopper by abutting on a part of the sheet stopper, and holds the sheet stopper at the second acute angle with respect to the sheet stacking surface.

2. The sheet stop mechanism according to claim 1, wherein the support mechanism further includes an elastic support portion provided upstream of the rotation support portion in the sheet discharge direction in the attachment recess, wherein the elastic support portion comes in contact with the base end portion of the sheet stopper in the standing state, and is elastically deformed in a predetermined retracting direction from a reference position at which the elastic support portion holds the sheet stopper at the first acute angle with respect to the sheet stacking surface.

3. The sheet stop mechanism according to claim 1, wherein the support mechanism further includes a contact displacement portion provided upstream of the rotation support portion in the sheet discharge direction in the attachment recess, wherein the contact displacement portion comes in contact with the base end portion of the sheet stopper in the standing state, and is displaced in a predetermined retracting direction from a reference position at which the contact displacement portion holds the sheet stopper at the first acute angle with respect to the sheet stacking surface.

4. The sheet stop mechanism according to claim 3, wherein the support mechanism further includes an elastically biasing portion configured to hold the contact displacement portion at the reference position by applying an elastic force to the contact displacement portion until a load of a plurality of sheets is applied to a tip end portion of the sheet stopper and the contact displacement portion receives a pressing force exceeding a predetermined upper-limit pressure from the base end portion in the retracting direction.

5. An image forming apparatus comprising:

a sheet conveyance device configured to convey a sheet along a sheet conveyance path and discharge the sheet from a sheet discharge port of the sheet conveyance path;

a print device configured to form an image on the sheet conveyed along the sheet conveyance path;

a discharge tray having an upper surface that is a sheet stacking surface configured to receive the sheet discharged from the sheet discharge port; and the sheet stop mechanism according to claim 1 provided in the discharge tray.

6. The image forming apparatus according to claim 5, further comprising:

a lower unit including the print device and the sheet conveyance device; and an upper unit including an image reading device configured to read an image from a document sheet and an operation portion protruding downstream from the image reading device in the sheet discharge direction, the upper unit being located above the lower unit and connected with the lower unit, wherein the discharge tray is formed on an upper surface of the lower unit and arranged to face a lower surface of the upper unit, and the sheet stopper is provided below the operation portion.

* * * * *